US005575693A

United States Patent [19]

Dykas et al.

[11] Patent Number: 5,575,693

[45] Date of Patent: Nov. 19, 1996

[54] BATTERY POST CONNECTOR

[75] Inventors: Glen D. Dykas; Daniel G. Lam, both of Macomb County, Mich.

[73] Assignee: The United States of America as represented by the Secretary of the Army, Washington, D.C.

[21] Appl. No.: 541,065

[22] Filed: Oct. 11, 1995

[51] Int. Cl.[6] ..... H01R 4/50

[52] U.S. Cl. ..... 439/773; 439/772

[58] Field of Search ..... 439/754, 772, 439/773, 759, 799

[56] References Cited

U.S. PATENT DOCUMENTS

| | | | |
|---|---|---|---|
| 1,930,772 | 10/1933 | Richter et al. | 439/759 OR |
| 2,706,284 | 4/1955 | Hoggart et al. | 439/772 X |
| 4,385,796 | 5/1983 | Eriksson | 439/772 OR |
| 4,758,188 | 7/1988 | Yates | 439/772 X |

*Primary Examiner*—Gary F. Paumen
*Assistant Examiner*—Daniel Wittels
*Attorney, Agent, or Firm*—Peter A. Taucher; David L. Kuhn

[57] ABSTRACT

An electrical connector that quickly clamps to or releases from a battery post has a band comprised of a flexible loop and a portion of the band remote from the loop. A flexible arm swingably mounts to the remote portion of the band, and a lever is journalled to one end of the arm. A leg of the lever connects to the loop, and the loop biases the leg away from the post. The electrical connector has a clamping configuration where the one end of the pivot arm is at a position relatively near the flat segment. The electrical connector has a post-releasing configuration where the one end of the arm is at a position relatively far from the flat segment. When the electrical connector goes from the clamping configuration to the release configuration, the one end of the arm swings through an intermediate position between its near and far positions. The arm is more elastically deformed in the intermediate position than in either the near or far positions.

9 Claims, 3 Drawing Sheets

BATTERY POST CONNECTOR

GOVERNMENT USE

The invention described here may be made, used and licensed by or for the U.S. Government for governmental purposes without paying me royalty.

BACKGROUND AND SUMMARY

Our invention is a connector by which an electrical cable is attached to the terminal post of a vehicle battery. For the US Army, which maintains thousands of vehicles, such connectors need to attach and detach from a terminal post as quickly and easily as possible. Although efficient connectors save only a small amount of time for each battery change, the aggregate savings they achieve for the Army's fleet is appreciable. The connectors must also have a secure mechanical attachment to the terminal post so that engine vibration and vehicle bounce do not loosen the connector from the terminal post.

Our connector firmly attaches to a terminal post by means of a metal band whose flexible loop cinches about the post. The band has a flat section integral with the loop, the flat section being stiffer than the loop. Affixed to the flat section is an element for swingably mounting a flexible arm to the ban. A lever is connected between the outer, or swung, end of the arm and the loop. The arm, lever and loop cooperate to form a mechanically bistable structure which switches the connector between a post locking configuration and a post releasing configuration.

DETAILED DESCRIPTION

Figure 1:
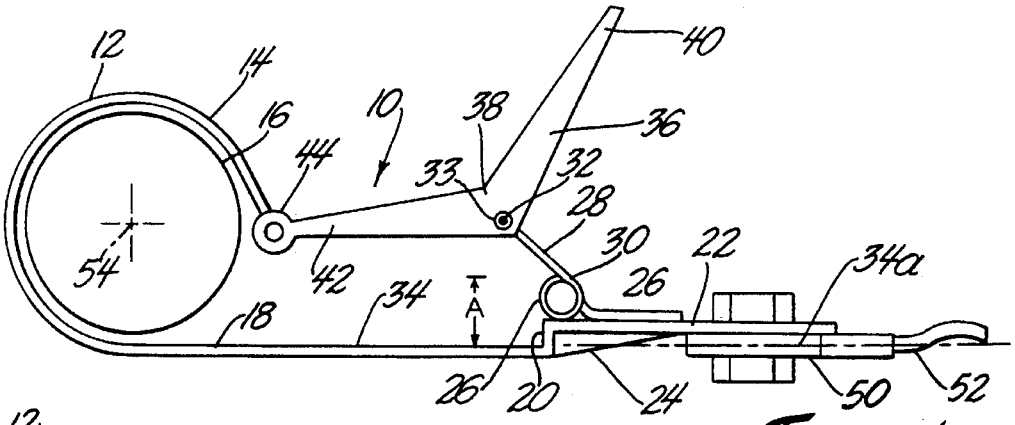
FIG. 1 is a side elevational view of a first embodiment of our connector in a post releasing configuration.

In FIG. 1 is shown a battery post connector 10 configured so that the a loop 14 of the connector's flexible band 12 encircles most of battery terminal post 16 and is radially spaced therefrom. Connected directly to and typically integral with loop 14 is a straight mediate segment 18, segment 18 being stiffer than loop 14. Segment 18 has a generally flat elongate surface 34 lying in plane 34*a*. At one end of mediate segment 18 is a step segment 20 which connects segment 18 to the band's final, offset segment 22. Offset segment 22 is so called because it is offset or spaced from plane 34*a* by step segment 20.

Step segment 20 and the adjacent zones of segments 18 and 22 form a generally Z-shaped structure remote from loop 14 that can, if desired, be stiffened by a triangular rib 24 so that any relative motion between segments 18 and 22 is prevented. Bolted or otherwise suitably connected to offset segment 22 is an electrical contact 50 from which leads electrical line or cable 52.

Fixed to offset segment 22 is a flexible coil 26 to which attaches proximal end 30 of a flexible pivot arm 28, the arm terminating in distal end 32. Proximal end 30 is offset from mediate segment 18 by a distance "A", or stated another way, proximal end 30 is spaced a distance "A" from plane 34*a*. Arm 28 can swing on coil 26 counterclockwise from the arm's FIG. 1 position, where distal end 32 points away from surface 34 and is farther from surface 34 than is proximal end 30. The arm swings to the FIG. 2 position, where distal end 32 points toward surface 34 and is closer to surface 34 than is proximal end 30.

Figure 2:
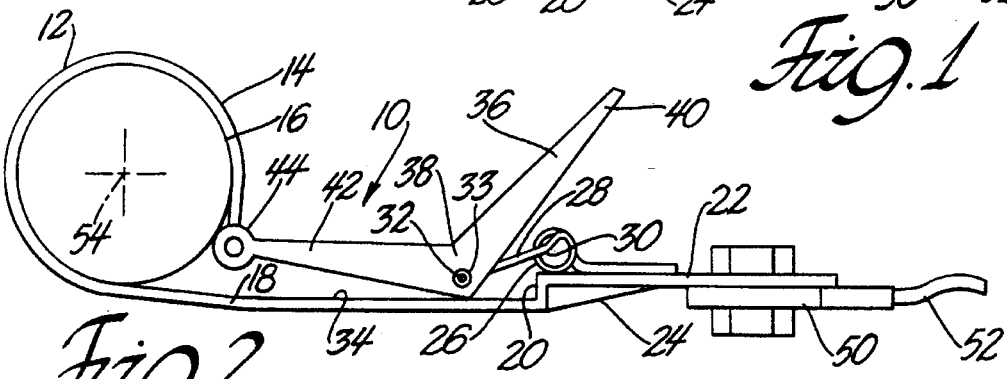
FIG. 2 is a side elevational view of the first embodiment of the connector in a post locking configuration.

Pivoted to distal end 32 is dog-legged lever 36. The lever's legs ordinarily form an angle of 110° to 130° with each other and in the figures the legs form an angle of 115°. The lever has a zone 38 where the levers tapered legs 40 and 42 meet, and zone 38 has an aperture 44 journalled with the distal end of 32 of arm 30. Although the journal connection between end 32 and zone 38 is typically loose as shown in FIGS. 1 and 2, the journal connection can be a close fit or a snug fit if desired. The combined length of leg 42 and pivot arm 28 is greater than the distance between coil 26 and battery post 16. This fact combined with the spring biases of band 14 and arm 28 causes connector 10 to be mechanically bistable, the stable configurations positions being those in FIG. 1 and FIG. 2.

Figure 7:
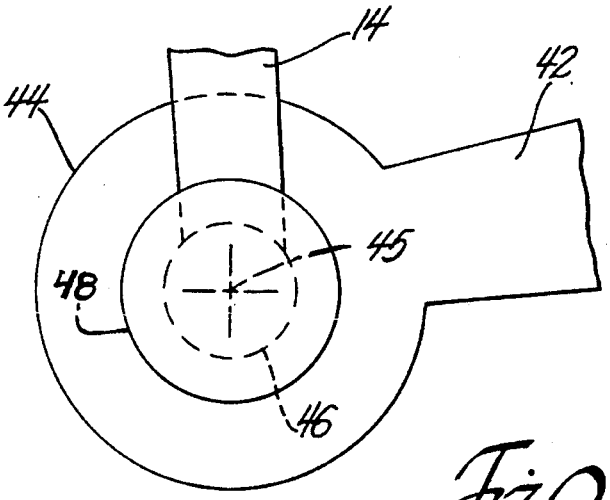
FIG. 7 is a detail view showing the engagement between a dog legged lever of our connector and the end of the flexible loop.

As shown in greater detail in FIG. 7, the outer end of arm 42 preferably has eye 44 by which lever 36 is pivoted about axis 45 to the end of loop 14. It can be seen that the end of loop 14 and eye 44 lie between post 16 and coil 26. Eye 44 pivots on a rod 46 that is fixed to the band 14, and either end of rod 46 has a head 48 to retain the eye on the rod. As an alternative, the connection between loop 14 and arm 42 can be a simpler, fixed connection.

In FIG. 1, connector 10 is in a "release" configuration which allows the connector to easily be slid off battery post 16. In this release configuration, pivot arm 28 is in a free state, having no elastic deformation. In FIG. 2, connector 10 is in a clamping configuration in which connector 10 securely grasps post 16. To move connector 10 from the release configuration to the clamping configuration, lever leg 40 is first swung about coil 26 toward post 16 (counterclockwise in FIG. 1) until eye 44 contacts post 16. Then, while keeping eye 44 in contact with post 16, dog leg lever 36 is swung about the axis 45 (FIG. 7) of eye 44 toward surface 34. The motion of dog leg lever 36 swings pivot arm 28 about coil 26 toward surface 34. Pivot arm 28 elastically bends as it swings about coil 26, the maximum amount of the pivot arm's bend occurring when the arm's distal end 32 lies in a mediate position directly between the arm's proximal end 30 and central axis 54 of post 16. At the finish of the pivot arm's swing about coil 26, the pivot arm is in its position shown in FIG. 2. The pivot arm is then either not bent at all or is essentially unbent compared to the arm's bend when distal end 32 is in the mediate position. The spring bias of pivot arm 28 now locks lever 36 in place so that connector 10 is held in its FIG. 2, clamping configuration.

Figure 3:
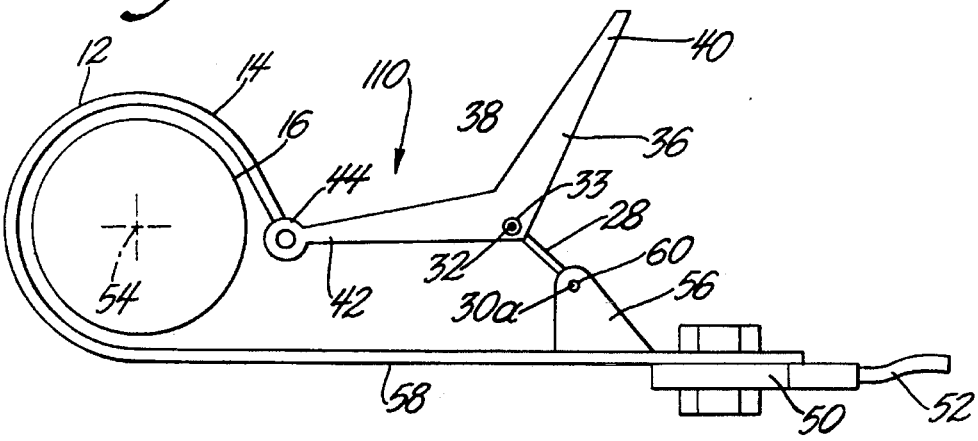
FIG. 3 is a side elevational view of a second embodiment of the connector in a post releasing configuration.

FIG. 3 shows a modification 110 of the first, FIG. 1 embodiment, elements in FIG. 3 common to FIG. 1 and having the same reference numbers. In FIG. 3 is a triangular mount 56 which replaces coil 26 of FIG. 1. Also in FIG. 3, a single straight, continuous band segment 58 replaces band segments 18 and 20 of FIG. 1.

Figure 4:
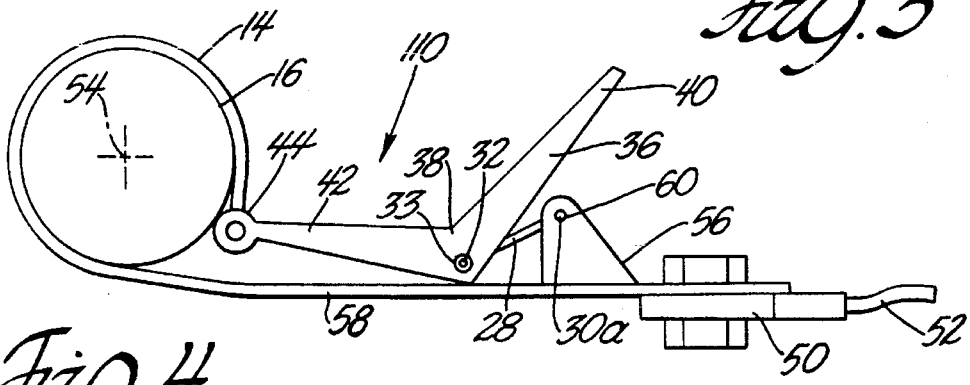
FIG. 4 is a side elevational view of the second embodiment of the connector in a post locking configuration.

Still referring to FIG. 3, triangular mount 56 is essentially a rigid bracket that stiffens the region of band segment 58 remote from loop 14 and near the mount. Mount 56 also serves as a pivotal mounting site for arm 28. Mount 56 defines an aperture 60 in which is journalled a modified proximal end 30*a* of flexible pivot arm 28. As before, the combined length of leg 42 and pivot arm 28 is greater than the distance between aperture 60 and battery post 16. The FIG. 3 modification 110 operates mainly in the same way as connector 10, the difference in operation of modification being that dog-legged lever swings about aperture 60 instead of swinging about a coil. In FIG. 3, connector 110 is in the "release" configuration analogous to FIG. 1, and in FIG. 4, connector 110 is in a clamping configuration analogous to FIG. 2.

Figure 5:
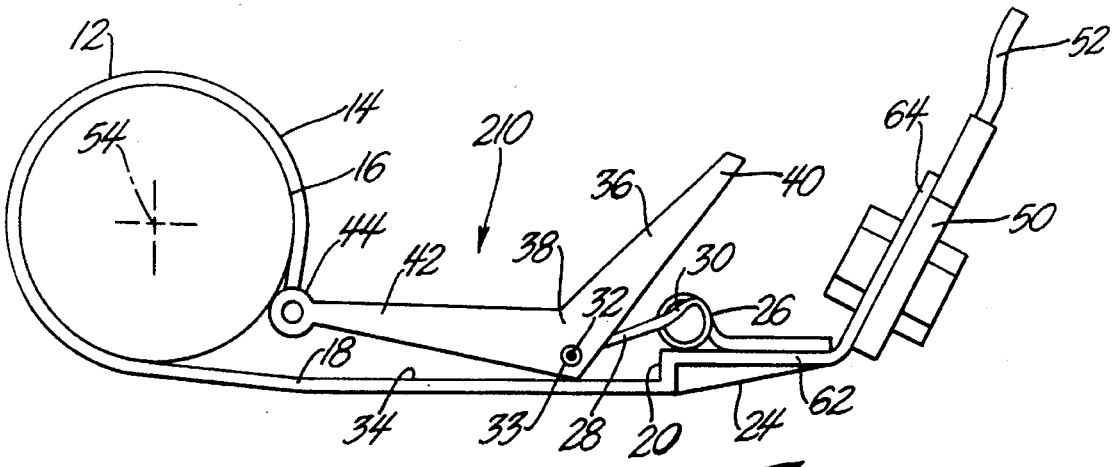
FIG. 5 is a side elevational view of a third embodiment of the connector in a post locking configuration.

FIG. 5 shows another embodiment 210 of post connector 10, wherein straight offset segment 22 of connector 10 is replaced by a bent offset segment 62 of embodiment 210. Segment 62 is bent to form an obtuse angle such that a portion of segment 62 faces generally toward lever 36, and so that lever 36 lies between post 16 and terminus zone 64 of segment 62. Zone 64 deters unintended bumping of lever 36 so that lever 36 is not accidentally pivoted from its FIG. 5 position, where the lever locks loop 14 onto post 16.

Figure 6:
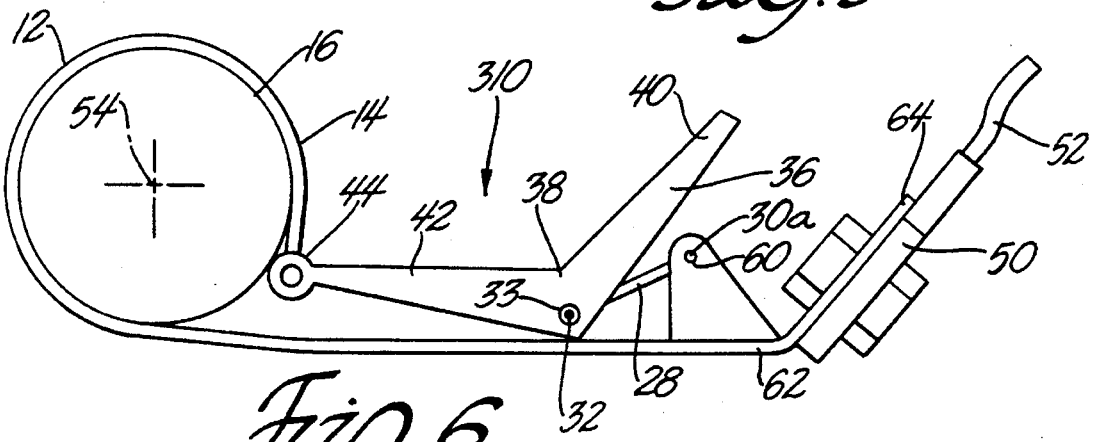
FIG. 6 is a side elevational view of a fourth embodiment of the connector in a post locking configuration.

FIG. 6 shows embodiment 310, which is embodiment 110 adapted to have offset segment 62 instead of offset segment 22.

Figure 9:
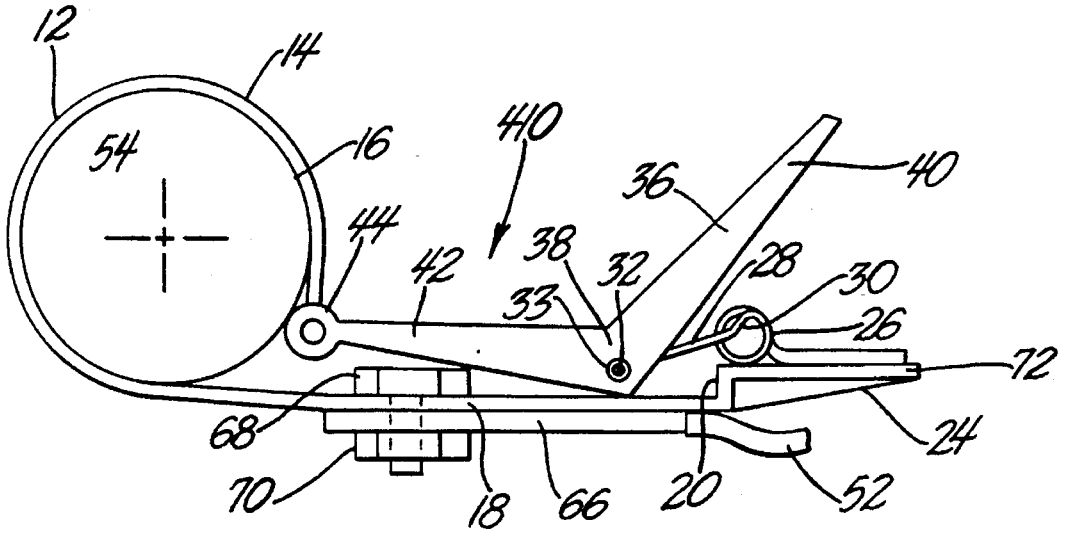
FIG. 9 is a side elevational view of a fourth embodiment of the connector in a post locking configuration.

FIG. 9 shows still another embodiment 410 of my post connector, embodiment 410 being a modification of connector 10 wherein electrical contact 50 of connector 10 is replaced by an elongate rigid metal plate 66. Plate 66 is pressed adjacently against mediate segment 18 of band 12 by a suitable fastening mechanism such as the combination of bolt 68 and nut 70. Plate 66 not only serves as an electrical contact between electrical cable 52 and segment band 12 but also serves to stiffen mediate segment 18 of band 12. Thus plate 66 may be regarded as a dual purpose element. Embodiment 410 is also has a modified offset segment 72, which is similar to but shorter than the analogous offset element 22 of post connector 10.

Figure 8:
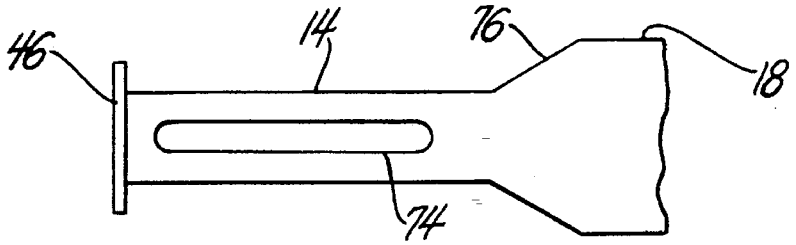
FIG. 8 is a plan elevational view of the loop and adjacent element wherein the loop has been laid out flat.

In FIG. 8, for purposes of illustration, loop 14 and the adjoining part of mediate segment 18 are shown as they would appear if loop 14 were rolled out flat. Segment 18 is wider and stiffer than loop 14, which has an elongate slot 74 therein to reduce stiffness. Between loop 14 and segment 18 is a transition zone 76 that tapers from segment 18 to loop 14. It is contemplated that loop 14 and the adjoining portion of transition zone 76 will contact post 16 when connector 10 is in the FIG. 2, clamping configuration.

Figure 10:
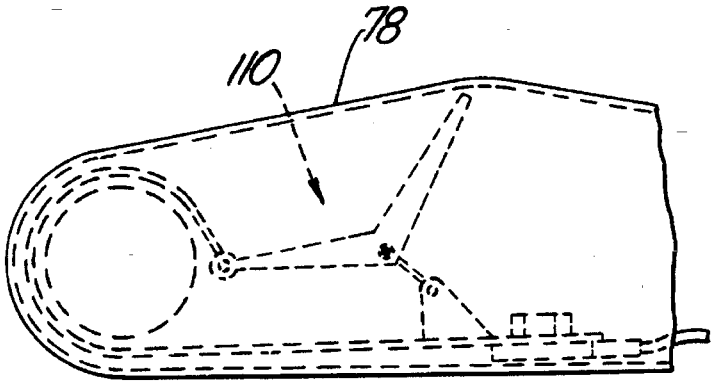
FIG. 10 is a side elevational view of the second embodiment of thye connector in the post releasing configuration and covered by an elastomeric boot.

Any of the connectors shown herein may have an insulating flexible boot of rubber or other suitable elastomeric material as shown at 78 in FIG. 10. The boot allows the connector to be placed on terminal post 16 without danger of shock and protects the connector and post as well.

We wish it to be understood that we do not desire to be limited to the exact details of construction or method shown herein since obvious modifications will occur to those skilled in the relevant arts without departing from the spirit and scope of the following claims.

What is claimed is:

1. A mechanically bistable electrical connector that quickly claps to or releases from a terminal post, comprising:

a band;

a flexible loop of the band;

a portion of the band remote from the loop;

a flexible arm having a distal end and a proximal end, the arm swingably connected at the proximal end to the remote portion of the band;

a lever connected to the distal end of the arm, the lever being pivotable relative to the arm;

a leg of the lever connected to the loop, the leg biased away from the post by the loop;

the connector having a clamping configuration where the distal end of the pivot arm is at a proximal location relative to the band portion;

the connector having another configuration where the distal end is at a location farther from the band portion than the proximal location, and the pivot arm is more deformed than during the proximal location.

2. The connector of claim 1 wherein the combined length of the leg and the arm in its free state is greater than the distance between the proximal end and the post.

3. The connector of claim 2 wherein and end of the leg is pivotally connected to an end of the loop.

4. The connector of claim 1 further comprising a dual purpose means for stiffening the portion of the band remote from the loop and for providing a pivotal mount connection for the arm.

5. The connector of claim 4 wherein the dual purpose means comprises a bracket affixed to the remote portion of the band, the bracket defining an aperture in which is journalled the arm.

6. The connector of claim 1 further comprising a terminus zone integral with the band portion, the terminus zone forming an obtuse angle with the portion such that the lever lies between the loop and the terminus zone, whereby the band partly encircles the lever.

7. The connector of claim 1 wherein the loop is narrower in width than a remainder of the band, and the loop defines an elongate slot therealong.

8. The connector of claim 2 wherein the dual purpose means is a first dual purpose means, the connector further comprising:

a section of the band between the loop and the band portion;

a second dual purpose means for stiffening the section and for providing electrical connection between the band and an electrical line.

9. An electrical connector for rapidly clamping or releasing a terminal post, comprising:

an electrically conductive metal band;

a flexible loop of the metal band at one end of the metal band;

an elongate, generally flat segment of the band integrally joined to the loop, the flat segment stiffer than the loop;

a flexible pivot arm having a proximal end and a distal end;

means journalled with the proximal end for swingingly engaging the pivot arm to the band;

a dog-legged lever pivotally mounted on the distal end of the arm;

a leg of the lever;

means on the leg for connecting the leg to the loop, the connecting means biased away from the post by the loop;

means for stiffening a portion of the band remote from the loop and for establishing electrical contact between the band and a cable;

the connector having a first configuration wherein the distal end of the arm is at a remote location relative to the flat segment, the arm is in a free state and the connecting means is clear of the post;

the connector having a second configuration wherein the distal end of the arm is at an intermediate location closer to the flat segment than the remote location, the pivot arm is elastically deformed and oriented toward the post, and the connecting means bears against the post;

the connector having a third configuration wherein the distal end of the arm is at a proximal location closer to the flat segment than the intermediate location, the pivot arm is less elastically deformed than during the second configuration, and the connecting means bears against the post.

* * * * *